US007707839B2

(12) United States Patent
Altunan

(10) Patent No.: US 7,707,839 B2
(45) Date of Patent: May 4, 2010

(54) DECLOGGING DEVICE AND DECLOGGING METHOD

(76) Inventor: Gurol Altunan, Arcelik A.S., Bulasik Makinas Isletmesi, Ankara (TR) 06931

( * ) Notice: Subject to any disclaimer, the term of this patent is extended or adjusted under 35 U.S.C. 154(b) by 874 days.

(21) Appl. No.: 10/540,430

(22) PCT Filed: Dec. 16, 2003

(86) PCT No.: PCT/TR03/00095

§ 371 (c)(1),
(2), (4) Date: Jan. 3, 2006

(87) PCT Pub. No.: WO2004/059225

PCT Pub. Date: Jul. 15, 2004

(65) Prior Publication Data

US 2006/0196209 A1 Sep. 7, 2006

(30) Foreign Application Priority Data

Dec. 26, 2002 (TR) ..... A 2002 02732

(51) Int. Cl.
*F25B 45/00* (2006.01)

(52) U.S. Cl. ..... 62/77; 62/303; 134/22.12

(58) Field of Classification Search ..... 62/303, 62/474, 475, 298, 195, 85, 77, 149, 292; 137/240, 239; 134/166 R, 166, 167 C, 22, 134/22.22, 22.11, 22.12
See application file for complete search history.

(56) References Cited

U.S. PATENT DOCUMENTS

| | | | | | |
|---|---|---|---|---|---|
| 3,295,538 | A | * | 1/1967 | Williams, Jr. | 134/111 |
| 3,503,221 | A | | 3/1970 | Martin | |
| 4,887,435 | A | | 12/1989 | Anderson, Jr. | |
| 4,934,390 | A | * | 6/1990 | Sapp | 134/22.18 |
| 5,318,700 | A | * | 6/1994 | Dixon et al. | 210/712 |
| 5,375,426 | A | * | 12/1994 | Burgener | 62/85 |
| 5,544,492 | A | * | 8/1996 | Manz | 62/85 |
| 5,544,494 | A | * | 8/1996 | Manz et al. | 62/292 |
| 5,632,153 | A | * | 5/1997 | Ricklefs et al. | 62/85 |
| 6,164,080 | A | * | 12/2000 | Mika et al. | 62/85 |
| 6,203,623 | B1 | * | 3/2001 | Xia | 134/1 |
| 6,260,390 | B1 | * | 7/2001 | Carr | 68/18 R |
| 6,619,051 | B1 | * | 9/2003 | Kilawee et al. | 62/78 |
| 2003/0102012 | A1 | * | 6/2003 | Osborne et al. | 134/18 |

FOREIGN PATENT DOCUMENTS

| | | | | |
|---|---|---|---|---|
| JP | 06 207765 | A | | 7/1994 |
| JP | 07 127953 | A | | 9/1995 |
| JP | 2001 174111 | A | | 6/2001 |
| JP | 2001-174111 | A | * | 6/2001 |
| JP | 2001 183035 | A | | 7/2001 |

* cited by examiner

*Primary Examiner*—Mohammad M Ali
(74) *Attorney, Agent, or Firm*—Venable, Campillo, Logan & Meaney PC

(57) ABSTRACT

This invention relates to a declogging device (9) and declogging method used to declog and clean the precipitation of metal dusts, compressor oil and the foreign matters in the refrigeration cycle (1) in a refrigerator.

2 Claims, 4 Drawing Sheets

DECLOGGING DEVICE AND DECLOGGING METHOD

This invention relates to a declogging device and a declogging method used to clean the material which clogs the circulation of the fluid by blocking the refrigeration cycle in a refrigerator.

The metal dust caused by the corrosion of the compressor which circulates the fluid of the refrigerator, compressor oil mixed with the refrigeration cycle and other foreign matters in refrigerators precipitate in the capillary tubes, block the refrigeration cycle and obstruct the continuation of the fluid of the refrigerator. Various methods have been used to prevent and eliminate the clogging, however necessary apparatus for these methods are generally integrated with the refrigerator and eliminate the clogging only in there.

The object of American Patent No. U.S. Pat. No. 6,006,544 is to prevent the clogging by means of the structural arrangements in the additional parts of the capillary tubes in the refrigeration cycle.

American Patent No. U.S. Pat. No. 4,998,412 defines a system which warns for a precipitation and cleans it in the refrigeration cycle.

American Patent No. U.S. Pat. No. 3,848,624 discloses a self-cleaning valve in the refrigeration cycle.

The object of this invention is to provide a declogging device and a declogging method used to eliminate the clogging in the refrigeration cycles.

The declogging device and the declogging method are explained by the attached drawings below.

Figure 1:
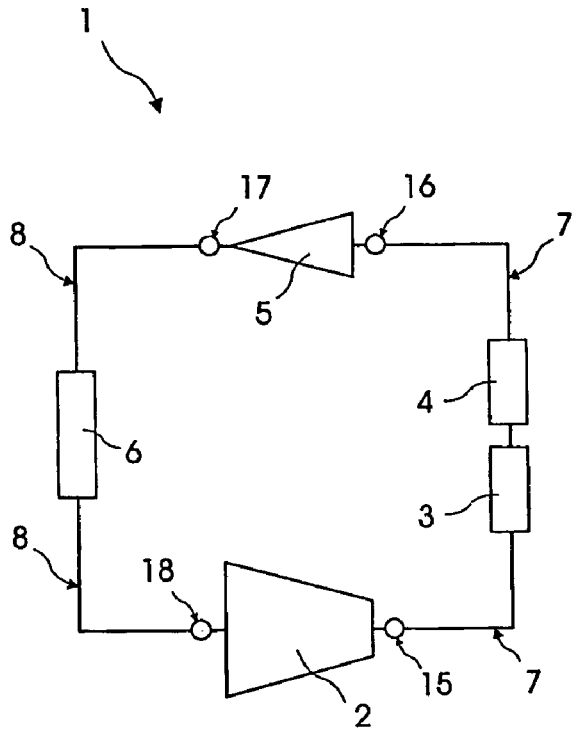
FIG. 1 is a schematic view of a refrigeration cycle.
Figure 2:
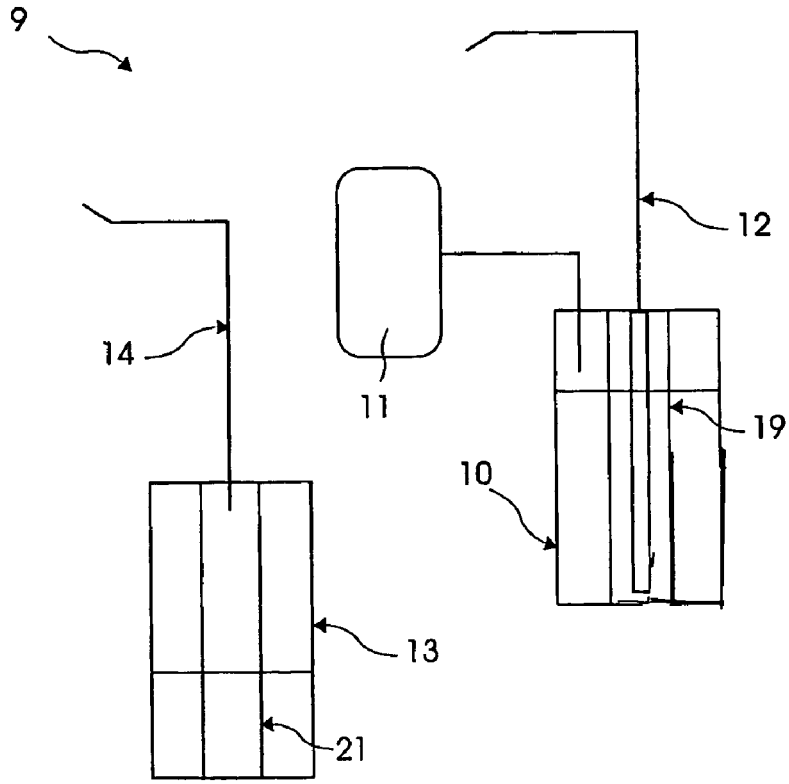
FIG. 2 is a schematic view of a declogging device.
Figure 3:
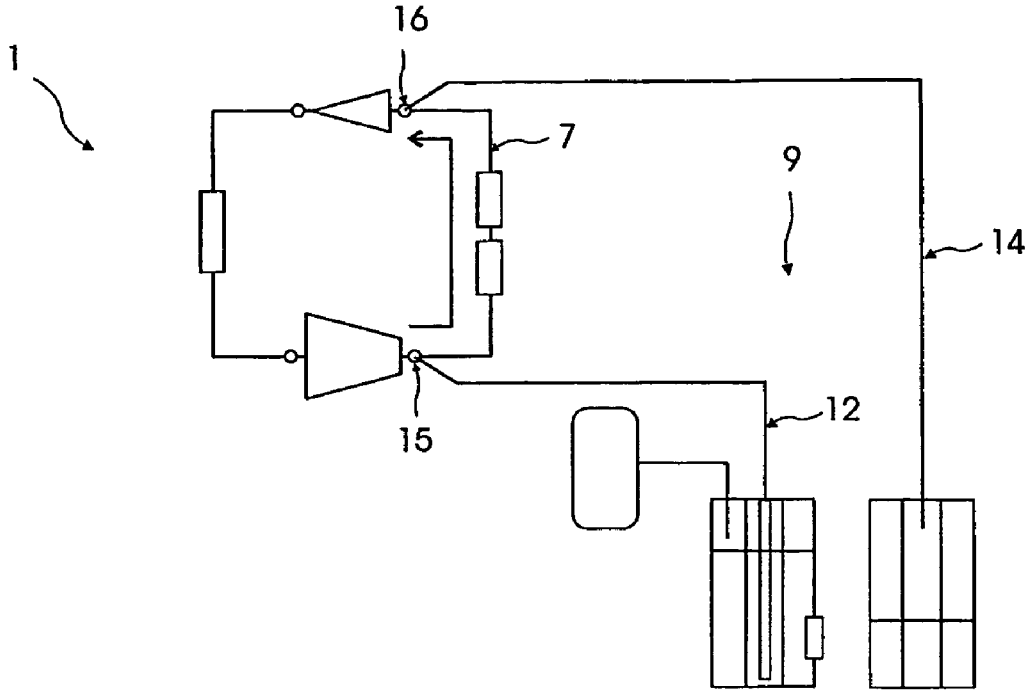
FIG. 3 is a schematic view of the connection way of a declogging device to the passage line of a refrigeration cycle.
Figure 4:
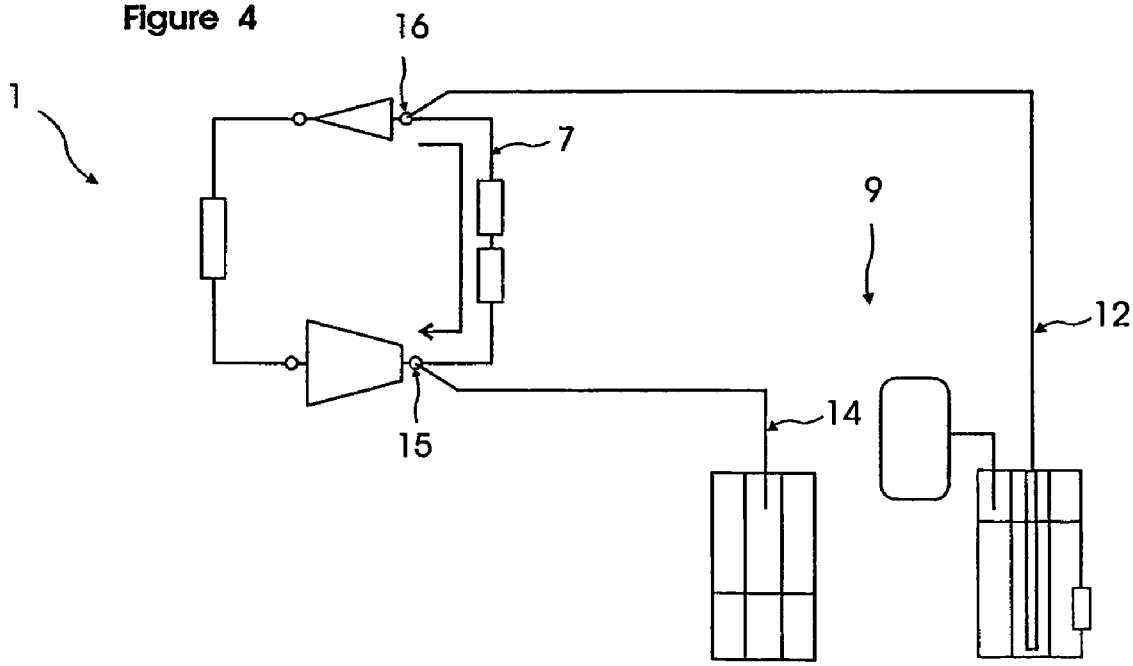
FIG. 4 is a schematic view of the connection way with replaced connection points of a declogging device to the passage line of a refrigeration cycle.
Figure 5:
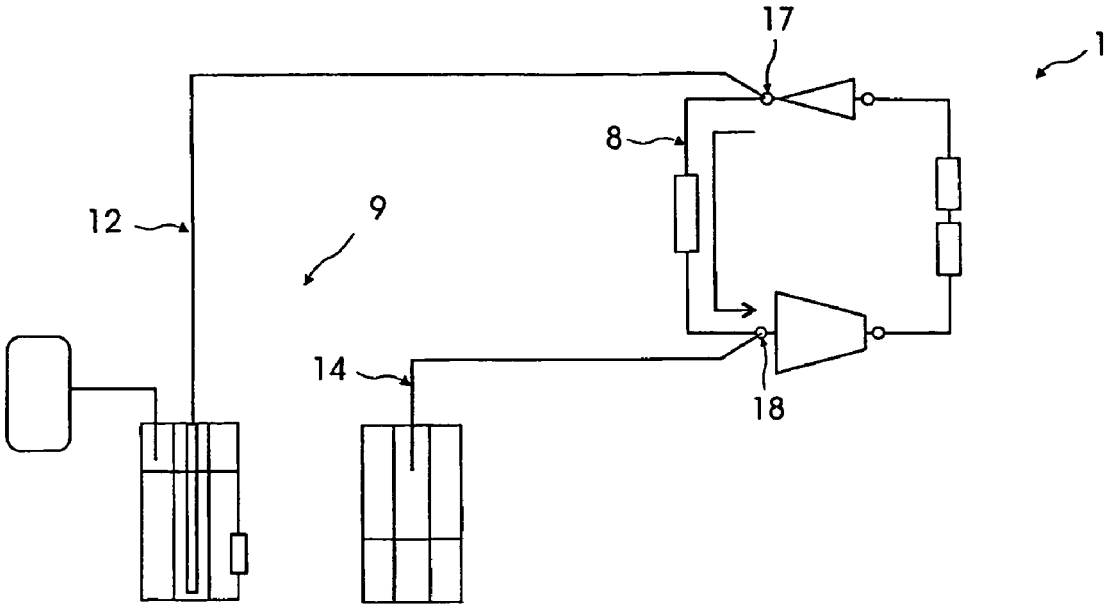
FIG. 5 is a schematic view of the connection way of a declogging device to the return line of a refrigeration cycle.
Figure 6:
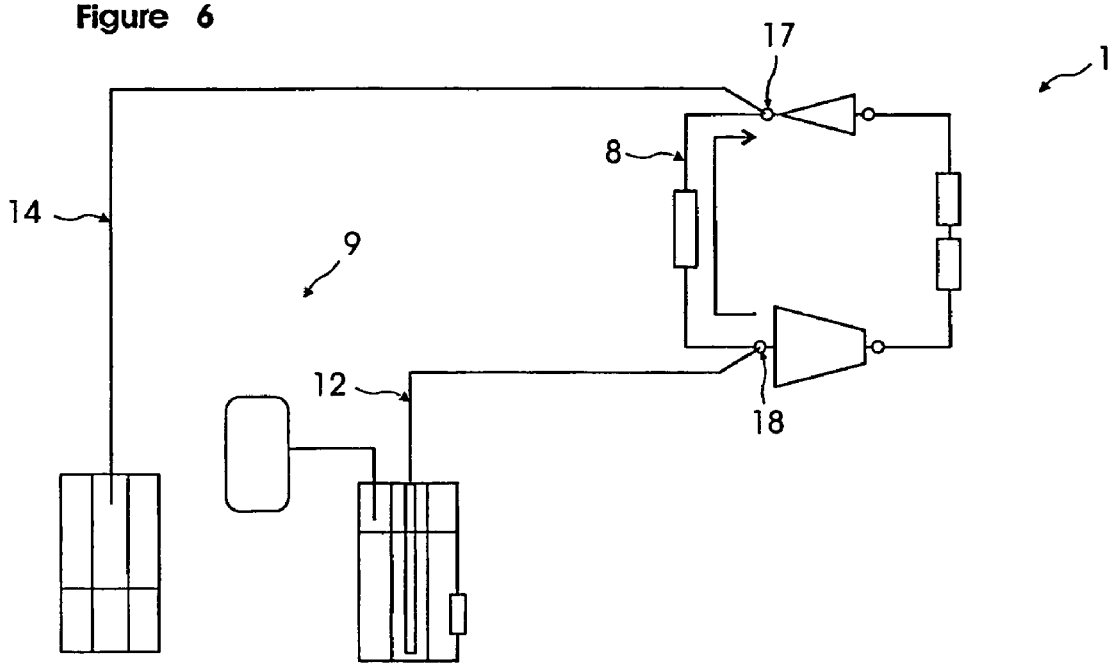
FIG. 6 is a schematic view of the connection way with replaced connection points of a declogging device to the return line of a refrigeration cycle.
Figure 7:
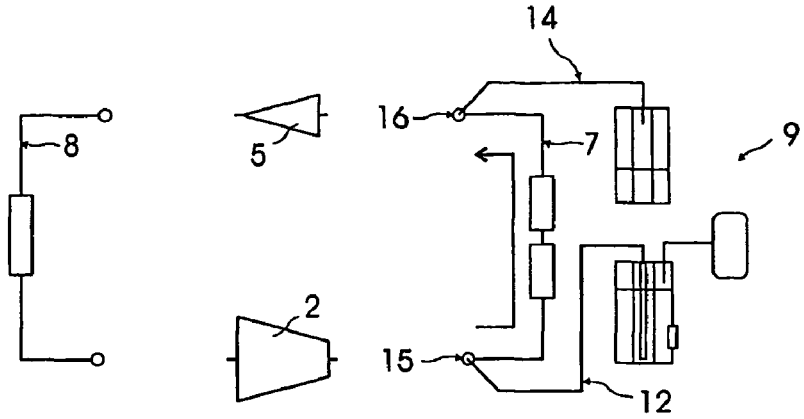
FIG. 7 is a schematic view of the connection way of a declogging device to the passage line of a divided refrigeration cycle.
Figure 8:
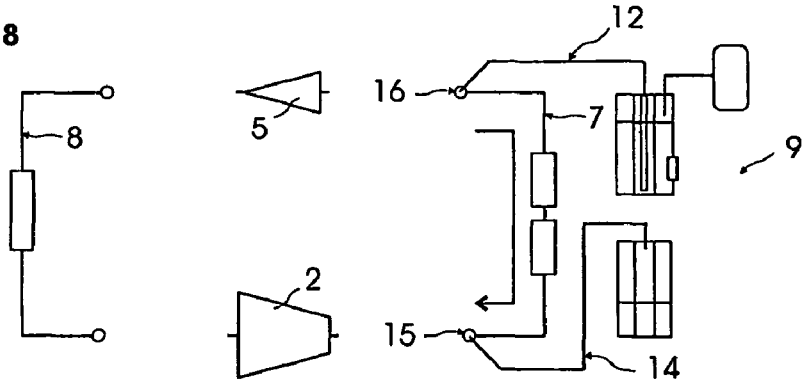
FIG. 8 is a schematic view of the connection way with replaced connection points of a declogging device to the passage line of a divided refrigeration cycle.
Figure 9:
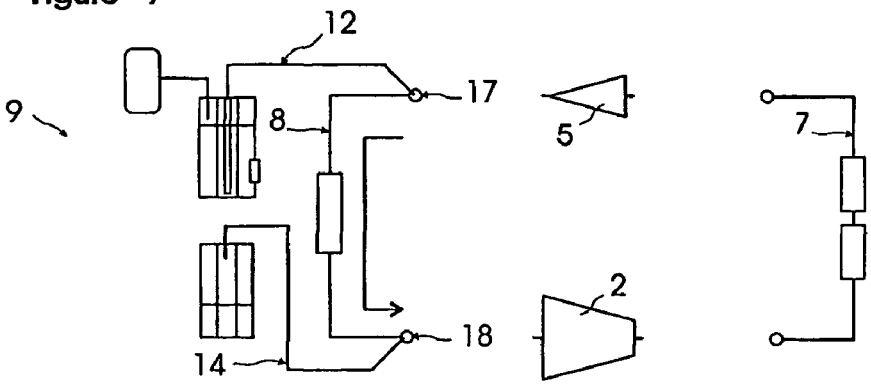
FIG. 9 is a schematic view of the connection way of a declogging device to the return line of a divided refrigeration cycle.
Figure 10:
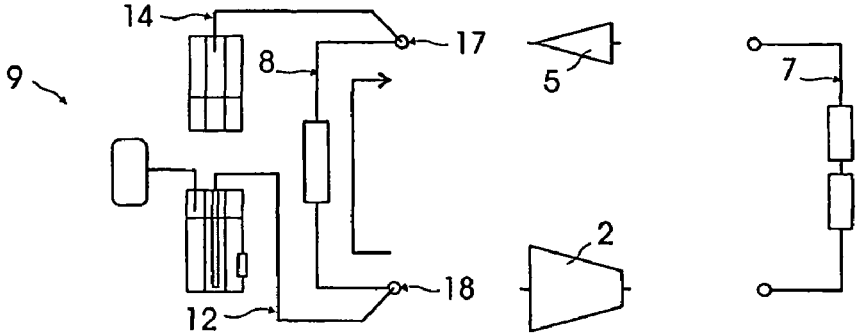
FIG. 10 is a schematic view of the connection way with replaced connection points of a declogging device to the return line of a divided refrigeration cycle.

In figures each part has been numbered corresponding the following:

1. Refrigeration cycle
2. Compressor
3. Heater
4. Condenser
5. Dryer
6. Evaporator
7. Passage line
8. Return line
9. Declogging device
10. Chemical substance tank
11. Pressurized gas tube

12. Transmission pipe
13. Collection tank
14. Collector pipe
15. Passage line inlet
16. Passage line outlet
17. Return line inlet
18. Return line outlet
19. Pre-filter
20. Injection pipe
21. Final filter
22. Chemical substance heater Refrigerators generally comprise a refrigeration cycle (1) in which the refrigeration fluid circulates. Refrigeration cycle (1) comprises a compressor (2), a heater (3), a condenser (4), a dryer (5), an evaporator (6), a passage line (7) which transfers the refrigeration fluid from the compressor (2) to the dryer (5) and a return line (8) which transfers the refrigeration fluid back from the dryer (6) to the compressor (2).

A declogging device (9) is used to eliminate the clogging in the refrigeration cycle (1).

The declogging device (9) which is the subject of the invention comprises a chemical substance tank (10) where the cleansing chemical substance is filled, a pressurized gas tube (11) which provides pressurized gas to the chemical substance tank (10) and a collection tank (13) where all cleansing chemical substances are finally collected.

In order to provide the connection with the declogging device (9), the passage line (7) comprises a passage line inlet (15) close to the compressor (2) outlet and a passage line outlet (16) close to the dryer (5) inlet.

In order to provide the connection with the declogging device (9), the return line (8) comprises a return line inlet (17) close to the dryer (5) outlet and a return line outlet (18) close to the compressor (2) inlet.

Chemical substance tank (10) comprises a transmission pipe (12) which transfers the cleansing chemical substance to the refrigeration cycle (1), a prefilter (19) which is used to filter the foreign matters mixed in during the filling of cleansing chemical substance and an injection pipe (20) preferably made of teflon which provides the pressurized exit of the cleansing chemical substance from the chemical substance tank (10) when sufficient pressure is applied.

In another embodiment of the invention, the chemical substance tank (10) comprises a chemical substance heater (22) which facilitates the transfer of the chemical substance.

The collection tank (13) comprises a collector pipe (14) which returns the cleansing chemical substance from the refrigeration cycle (1) and a final filter (21) which enables the reuse of the cleansing chemical substance after filtering the foreign matters following its circulation in the refrigeration cycle (1).

In order to prepare a clogged refrigeration cycle (1) to the declogging process, compressor (2) and dryer (5) are detached and passage line (7) and return line (8) are split apart.

For the elimination of the clogging in the passage line (7), the conveyor (12) and the collector (14) are connected to the passage line inlet (15) and the passage line outlet (16) respectively. The pressurized gas tube (11) is opened and the cleansing chemical substance is forwarded from the chemical substance tank (10) to the passage line (7). In case it is not declogged, the pressure is increased and/or the cleansing chemical substance is passed in the reverse direction by connecting the transmission pipe (12) and the collector pipe (14) to the passage line outlet (16) and the passage line inlet (15) respectively. After it is declogged, certain amount of the cleansing chemical substance is passed from the passage line (7) for the cleaning process. If it is not cleaned sufficiently, the cleansing chemical substance is left at the passage line (7) for a while. Until the cleansing chemical substance is returned clean, it is continued to be passed from the passage line (7).

In order to declog the return line (8), the transmission pipe (12) and the collector pipe (14) are connected to the return line inlet (17) and the return line outlet (18) respectively. The pressurized gas tube (11) is opened and the cleansing chemical substance is forwarded from the chemical substance tank (10) to the return line (8). In case it is not declogged, the pressure is increased and/or the cleansing chemical substance is passed in the reverse direction by connecting the trnsmission pipe (12) and the collector pipe (14) to the return line outlet (18) and the return line inlet (17) respectively. After it is declogged, certain amount of the cleansing chemical substance is passed from the return line (8) for the cleaning process. If it is not cleaned sufficiently, the cleansing chemical substance is left at the return line (8) for a while. Until the cleansing chemical substance is returned clean, it is continued to be passed from the return line (8).

As a pressurized gas tube (11) is used in the declogging device (1), oil which may be mixed with the pressurized gas obtained from the pressurized gas assembly prevents the risk of the substances such as metal dusts which may cause clogging being mixed within the system.

In the declogging device (1), a pressurized gas, preferably nitrogen with low moisture which will not react with the chemical substances is used.

In the declogging device (1), chemical substances preferably Acetone, Hexane, Alcohol and Chloroform which do not react with the other materials in the environment and can clean the accumulated dirt are used as solvent.

The invention claimed is:

1. A declogging method of using a declogging device (9) including a chemical substance tank (10) which is filled with a cleansing chemical substance used to eliminate clogging in a refrigeration cycle (1) where a refrigeration fluid circulates, a pressurized gas tube (11) which provides pressurized gas to the chemical substance tank (10) and a collection tank (13) where the cleansing chemical substance is collected, comprising the steps of: detaching a compressor (2) and a dryer (5) from the refrigeration cycle(1) and splitting a passage line (7) from a return line (8) for the preparation of the clogged refrigeration cycle (1) for a declogging process, connecting a transmission pipe (12) and a collector pipe (14) to a passage line inlet (15) and a passage line outlet (16) respectively for the declogging of the passage line (7), transferring of the cleansing chemical substance from the chemical substance tank (10) to the passage line; (7) opening a gas tube, in case the passage line (7) is not declogged, increasing of the pressure and/or reversing pass of the cleansing chemical substance by connecting the transmission pipe (12) and the collector pipe (14) to the passage line outlet (16) and the passage line inlet (15) respectively, passing of certain amount of the cleansing chemical substance from the passage line (7) for the cleaning process, in case the passage line (7) is not cleaned sufficiently, leaving the cleansing chemical substance at the passage line (7) for a while and continuing passing the cleansing chemical substance from the passage line (7) until the passage line (7) returns clean.

2. The declogging method of using the declogging device (9) as in claim 1 comprising the steps of connecting the transmission pipe (12) and the collector pipe (14) to the return line inlet (17) and the return line outlet (18) respectively for the declogging of the return line (8), transferreing of the cleansing chemical substance from the substance tank (10) to the return line (8) by opening the gas tube, in case the return line (8) is not declogged, increasing of the pressure and/or the reverse pass of the cleansing chemical substance by connecting the transmission pipe (12) and the collector pipe (14) to the return line outlet (18) and the return line inlet (17) respectively, passing of certain amount of the cleansing chemical substance from the return line (8) for the cleaning process, in case the return line (8) is not cleaned sufficiently, leaving the cleansing chemical substance at the return line (8) for a while and continuing of the passing the cleansing chemical substance from the return line (8) until the return line returns clean.

* * * * *